United States Patent [19]

DiBiano et al.

[11] Patent Number: 4,505,668

[45] Date of Patent: Mar. 19, 1985

[54] CONTROL OF SMOKE EMISSIONS FROM A FLARE STACK

[75] Inventors: Robert J. DiBiano; Kim A. Autenrieth; Gary W. Hales, all of Sweeny, Tex.

[73] Assignee: Phillips Petroleum Company, Bartlesville, Okla.

[21] Appl. No.: 339,802

[22] Filed: Jan. 15, 1982

[51] Int. Cl.[3] ..... F23D 13/20

[52] U.S. Cl. ..... 431/202; 431/4; 431/5; 431/79

[58] Field of Search ..... 431/4, 5, 12, 79, 202; 250/342; 340/578, 825.15, 630; 364/497, 496, 503, 162

[56] References Cited

U.S. PATENT DOCUMENTS

| | | | |
|---|---|---|---|
| 2,972,446 | 2/1961 | White | 364/503 X |
| 4,094,632 | 6/1978 | Reed et al. | 431/5 X |
| 4,187,542 | 2/1980 | Ball et al. | 431/12 X |
| 4,227,872 | 10/1980 | Zink et al. | 431/5 X |
| 4,233,596 | 11/1980 | Okamoto et al. | 431/79 X |
| 4,342,550 | 8/1982 | Tuck | 431/202 X |
| 4,360,336 | 11/1982 | Shepherd | 431/12 |

*Primary Examiner*—Larry Jones
*Assistant Examiner*—Carl D. Price
*Attorney, Agent, or Firm*—French and Doescher

[57] ABSTRACT

A measurement of the amount of infrared radiation coming from the flame associated with a flare stack is utilized to manipulate the flow of steam to the flare stack so as to reduce the emission of smoke from the flare stack when a combustible waste gas containing hydrocarbons is being burned in the flare stack.

11 Claims, 1 Drawing Figure

CONTROL OF SMOKE EMISSIONS FROM A FLARE STACK

Figure 1:
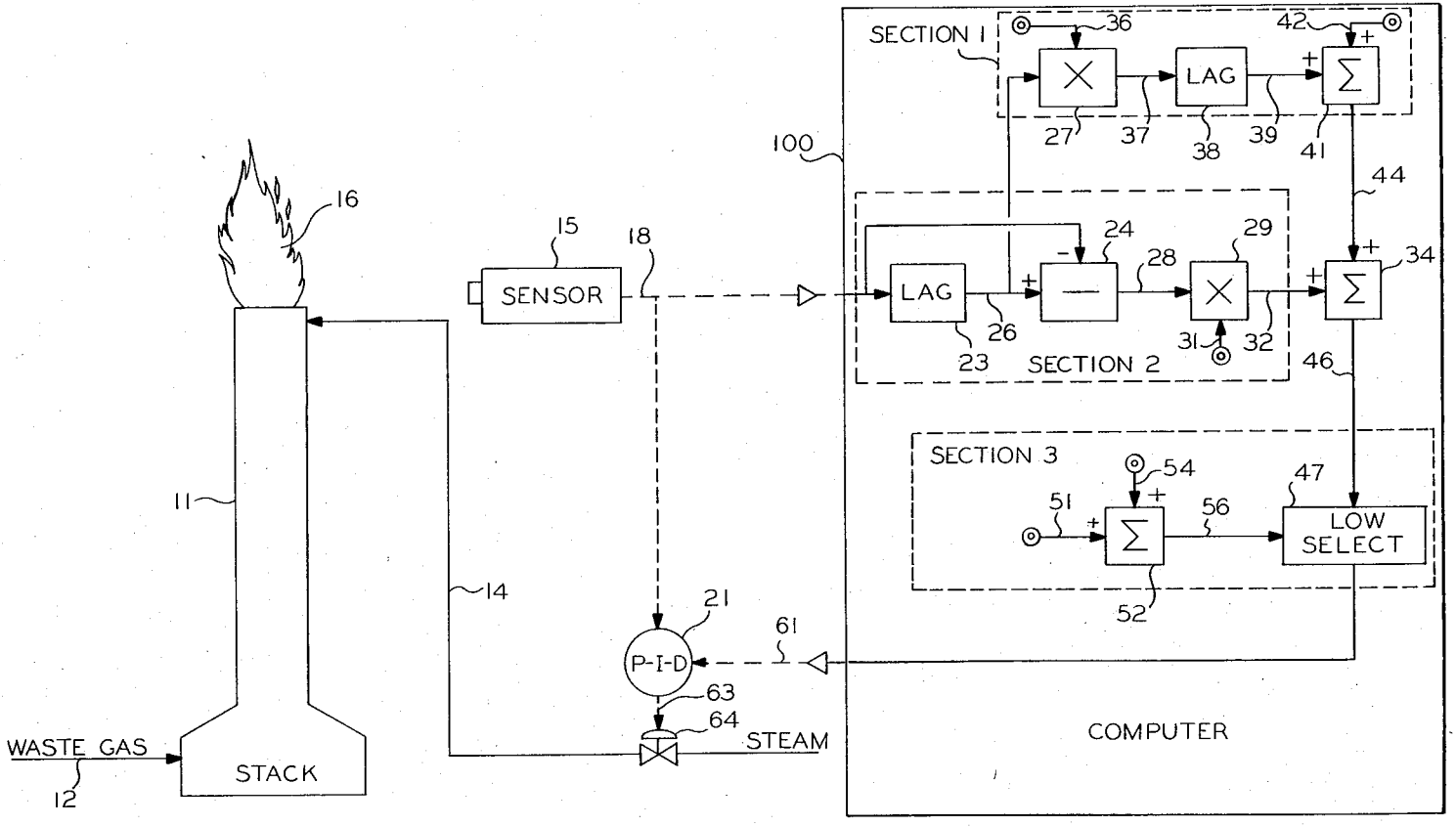

This invention relates to flare stack control. In one aspect this invention relates to method and apparatus for controlling smoke emissions from a flare stack. In another aspect this invention relates to method and apparatus for using a measurement of the infrared radiation from a flare flame to control smoke emissions from a flare stack.

It is common practice for refineries to dispose of combustible, hydrocarbon-containing waste gases by burning the waste gases in a flarestack. When hydrocarbons heavier than methane are contained in the waste gas, smoke will be produced because of incomplete combustion of the hydrocarbons. In order to alleviate the problem of smoking, steam is usually added at the combustion zone, which is generally the flare tip, in order to slow down the cracking of the hydrocarbons before the hydrocarbons have a chance to burn. If steam is added properly, the smoking problem will be alleviated and restrictions on flare stacks with respect to smoke can be met.

If the flow rate of the waste gas and the hydrocarbon composition of the waste gas are constant, it is possible to set the steam flow rate at a constant rate which will substantially eliminate smoking. However, the flow rates of the waste gas and hydrocarbon composition are generally not constant and it is thus necessary to either manipulate the flow rate of steam in response to varying flow rates and varying hydrocarbon compositions or to set the flow rate of steam at such a high level that no possible variation in the flow rate or hydrocarbon composition could result in smoking. It is much more desirable to control the steam flow rate than to set the steam flow rate at the high level referred to because such a high level of steam flow would result in excessive steam waste and the possibility of blowing the pilot flame in the flare stack out with steam.

It is known that the amount of infrared radiation from a flare flame is related to the tendency for smoke to be emitted from the flare. Carbon, which causes smoking, gives a more luminescent flame than hydrogen. However, a measurement of the amount of infrared radiation from a flare flame is generally very inaccurate because of interference caused by variations in environmental factors such as time of day, wind, and weather conditions. It thus has not been feasible in the past to directly control the steam flow to a flare stack in response to a measurement of flare radiation.

It is thus an object of this invention to provide method and apparatus for controlling smoke emissions from a flare stack using a control signal which is based on a measurement of infrared radiation from a flame to manipulate the flow rate of steam to the flare tip so as to substantially eliminate smoke using a minimum flow of steam.

In accordance with the present invention, a measurement of the amount of infrared radiation coming from the flare flame is processed to reduce interference caused by variations in environmental conditions and to accentuate radiation changes which are true indicators of a change in steam demand. The thus processed measurement is compared with the actual measurement of infrared radiation to derive a control signal which is representative of the flow rate of steam required to substantially eliminate smoking. The thus derived control signal is utilized to manipulate the flow of steam to the flare tip. Use of the measurement of infrared radiation for control results in a control system which can substantially eliminate smoking while avoiding the need for any measurements of flow rates of waste gas or the hydrocarbon composition of waste gas, which measurements are difficult to obtain.

Other objects and advantages of the invention will be apparent from the foregoing brief description of the invention and the claims as well as the detailed description of the drawing which is briefly described as follows:

FIG. 1 is a diagrammatic illustration of a flare stack and the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Transducing of these signals is not illustrated for the sake of simplicity because it is well known in the art that if a signal is in electrical form it must be transduced to pneumatic form if it is to be transmitted or used in pneumatic form. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signal based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate are compared by a controller. The output could be a signal representative of a desired change in the flow rate of some gas necessary to make the desired and actual flows equal. On the other hand, the same output signal would be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

Referring now to FIG. 1, there is illustrated a stack 11 to which a combustible waste gas stream containing hydrocarbons is provided through conduit means 12. Steam is provided through conduit means 14 to the flare tip of the stack 11.

The infrared radiation sensor 15 is placed in any suitable location where the sensor 15 can be trained on the flame 16. Any suitable infrared sensor may be utilized. The presently preferred sensor is a John Zinc Zoom Telescope and Detector, Type A-ST-0781, manufactured by John Zinc Company. Instruction sheets provided with this unit provide information regarding suitable locations for the unit. The output from this detector can range from 0–25 MV depending on the amount of radiation received.

The sensor 15 provides an output signal 18 which is representative of the radiation in the infrared region received by the sensor. A major component of this radiation will be the radiation from the flame 16. However, environmental factors such as the time of day, wind, weather conditions and other similar factors can have an effect on the radiation received by the sensor 15 and thus on the magnitude of signal 18. Signal 18 is provided from the sensor 15 as an input to the computer 100 and also as the process variable input to the controller 21.

Because of the many factors which affect the infrared radiation received by the sensor 15 other than the infrared radiation from the flame 16, it is not possible to directly control the steam flow rate based on the measured infrared radiation. The present invention utilizes a comparison between the measured radiation signal and a conditioned measured radiation signal to manipulate the steam flow rate. Conditioning of the measured radiation signal is utilized to account for false indicators of steam demands, such as bright sunlight, and enhance the responsiveness of the steam flow control during a true indication of steam demand.

In general, the undesired factors which affect the infrared radiation received by the sensor 15 cause small, gradual changes in the output from the sensor 15. An example of this is the increase or decrease in sunlight during daylight hours. In contrast, changes in the intensity of the flare 16 and thus in the infrared radiation provided from the flame 16 will generally cause large, rapid changes in the output signal from the sensor 15 and these large, rapid changes are considered true indicators of changes in infrared radiation from the flame 16 and thus changes in of steam demand.

The computer logic illustrated in FIG. 1 has been divided into three sections to simplify explanation of the logic. Section 1 is generally utilized to prevent false indicators of steam demand from having an affect on the control system. Section 2 is utilized to essentially amplify rapid changes in signal 18 so as to provide a quick response to a rapid change in the magnitude of signal 18 which indicates a change in the radiation from the flame 16. Section 3 is utilized to prevent the steam flow from being reduced too quickly during periods of rapid variation in the intensity of the infrared radiation from the flame 16. A detailed description of the computer logic and then a more general description of how Sections 1, 2 and 3 function follows.

Signal 18 is provided as an input to the lag block 23 and to the subtrahend input of the difference block 24. The lag block 23 represents a conventional control element which is essentially a delay having a particular time constant. The action of the lag block 23 is such that a change in signal 18 is not immediately reflected at the output of the lag 23. When the magnitude of signal 18 changes, the output of the lag will change over a period of time which is determined by the time constant until the output of the lag 23 does equal the input signal.

The output signal 26 from the lag 23 is provided to the minuend input of the difference block 24 and is also provided as an input to the multiplying block 27. Signal 26 is subtracted from signal 18 to establish signal 28 which is provided as an input to the multiplying block 29. The multiplying block 29 may be considered a gain the magnitude of which is determined by the magnitude of signal 31. Signal 28 is multiplied by signal 31 to establish signal 32 which is provided as an input to the summing block 34.

The multiplying block 27 may also be considered a gain the magnitude of which is determined by the magnitude of signal 36. Signal 26 is multiplied by signal 36 to establish signal 37 which is provided as an input to the lag block 38. Lag block 38 provides an output signal 39 as an input to the summing block 41 which may be considered a bias with the magnitude of the bias determined by the magnitude of signal 42. Signal 39 is summed with signal 42 to establish signal 44 which is provided as an input to the summing block 34.

Signals 32 and 44 are summed to establish signal 46 which is provided as a first input to the low select block 47. Essentially, signal 46 may be considered the computer generated set point and if the limit imposed by Section 3 is not violated, signal 46 will be the control signal provided from the computer 100.

Signal 51 is representative of the value of the set point provided from the computer 100 after the previous pass through the computer. Cycling of the computer and the generation of the last set point will be discussed more fully hereinafter. Signal 51, which will be retained in computer memory, is provided to the summing block 52. The summing block 52 is also provided with signal 54 which is representative of the maximum allowable increase in the set point signal provided from the computer 100 per pass through the computer. Signal 51 is summed with signal 54 to establish signal 56 which is provided as a second input to the low select 47. The lower of signals 46 and 56 is selected as the output signal 61 from the computer 100. Signal 61 is provided as the set point signal to the controller 21.

In response to signals 18 and 61, the controller 21 provides an output signal 63 which is responsive to the difference between signals 18 and 61. Signal 63 is scaled so as to be representative of the position of the valve 64, which is operably located in conduit means 14, required to maintain a steam flow rate which will substantially eliminate smoke from the flare stack 11. Signal 63 is provided from the controller 21 as the control signal for the control valve 64.

Referring now to the logic illustrated in FIG. 1 by sections, Section 1, as has been previously stated, is utilized to reduce the effects of false indications of flame radiation caused by environmental factors. Such environmental factors may take several minutes to cause any significant change in the magnitude of signal 18 while a change in infrared radiation from the flame 16 will cause a change in the magnitude of signal 18 in a very few seconds. Thus, the time constant of the lag 38 is preferably set at about 1 minute. If the magnitude of signal 18 changes slowly, signal 39 from the lag 38 will essentially track the changes in signal 18 which will prevent such slow changes in the magnitude of signal 18 from affecting the flow rate of steam through conduit means 14. However, if the magnitude of signal 18 changes quickly, signal 39 will not track such a quick change and there will be a difference between the magnitude of signal 18 and the magnitude of signal 61 which will cause the flow rate of the steam to be changed. Thus, Section 1 allows the set point to track signal 18 when environmental factors are causing changes in the magnitude of signal 18 and also helps to change the flow rate of steam when a rapid change in signal 18 indicates that a change in the steam flow rate is actually needed. The gain term 36 and the bias term 42 are essentially utilized to prevent supplying too much steam through conduit means 14 dye to the control action of Section 1. The bias term 42 may especially be considered a fine tuning term. A presently preferred value for the gain term 36 is 1.2 while a presently preferred value for the bias term 42 is 2.5

Referring now to Section 2, this Section is essentially utilized to amplify rapid changes in the process variable. The time constant of the lag 23 is preferably about 30 seconds. When a rapid change occurs in signal 18, signal 28 may take on a relatively large positive or negative magnitude. The magnitude change will be in the direction opposite the direction of the change in radiation. The contribution to the set point from Section 2 may be relatively large when the rapid change in signal 18 occurs and this contribution will have a significant impact on steam flow because the effect of Section 2 will be to increase the difference between the process variable signal and set point signal seen by controller 21.

The contribution from Section 2 will return to 0 after the magnitude of signal 26 again equals the magnitude of signal 18. It is noted that slow changes in signal 18 will not result in any signal output from Section 2. The gain term 31 is again used for fine tuning of the control system and presently has a preferred value of 1.0.

Referring now to Section 3, the presently preferred value of signal 54 is 1.0. Thus, for each pass through the computer 100, the magnitude of signal 61 cannot increase more than 1.0. This feature prevents the steam flow to the flare stack from being reduced too quickly during periods of rapid changes in steam demand.

As has been previously stated, a change in the infrared radiation from the flame 16 will very quickly cause a change in the magnitude of signal 18. Thus, it is desirable to have a very fast cycle time for the logic illustrated in FIG. 1. The presently preferred cycle time is about 2 seconds. As used herein, the term "cycle time" or "pass through the computer" refers to the time between calculations of a new value for the set point signal 61. Thus, for the 2 second cycle time, the magnitude of signal 61 may change every 2 seconds.

In summary, signal 61 is conditioned in such a manner that signal 61 essentially tracks signal 18 during periods of slow changes in the magnitude of signal 18. This effectively prevents environmental conditions which effect the output signal 18 from the sensor 15 from affecting the steam flow to the flare stack. When the magnitude of signal 18 changes rapidly, the magnitude of signal 61 may actually change rapidly in the opposite direction due to the influence of Section 2 of the logic so as to enhance the control action by changing the steam flow as needed. After a rapid change in the output of signal 18 occurs, signal 61 will over a period of time return to tracking signal 18 but the desired control action will have been accomplished.

It is noted that while preferred values for the lag time constants, gain terms and bias terms have been provided, other combinations of such terms could be utilized and might even be necessary for different installations. Typically, the magnitude of such terms is determined through experimentation with the control system after installation so as to optimize the control action of the logic illustrated in FIG. 1.

The invention has been described in terms of a preferred embodiment as illustrated in FIG. 1. A specific sensor 15 and computer 100 have been designated. The controller 21 and the control valve 64 are each well known, commercially available control components such as are illustrated and described at length in Perry's *Chemical Engineer's Handbook*, 4th Edition, Chapter 22, McGraw-Hill.

While the invention has been described in terms of the presently preferred embodiment, reasonable variations and modifications are possible by those skilled in the art and such variations and modifications are within the scope of the described invention and the appended claims.

That which is claimed is:

1. Apparatus comprising:

a flare stack;

means for supplying a combustible waste gas containing hydrocarbons to said flare stack, wherein said waste gas is burned in a combustion zone of said flare stack;

means for supplying steam to the combustion zone in said flare stack;

means for establishing a first signal representative of the amount of infrared radiation from the flare stack flame at a time T;

means for establishing the magnitude of a set point signal in response to the magnitude of said first signal at said time T and for generating said set point signal, wherein said set point signal has a magnitude which is not equal to the magnitude of said first signal if an increase in the flow rate of said steam is required to prevent the emission of smoke from said flare stack or if the flow rate of steam can be decreased without the emission of smoke from said flare stack occurring and wherein said set point signal has a magnitude substantially equal to the magnitude of said first signal if no change in the flow rate of said steam is desired;

means for comparing said first signal and said set point signal at said time T and for establishing a second signal which is responsive to the difference between said first signal and said set point signal; and means for manipulating the flow rate of steam to said flare stack in response to said second signal.

2. Apparatus in accordance with claim 1 wherein said means for establishing said first signal comprises an infrared radiation detector.

3. Apparatus in accordance with claim 1 wherein said means for establishing the magnitude of said set point signal comprises:

first lag means for lagging said first signal to thereby establish a third signal representative of a lagged said first signal;

means for subtracting said first signal from said third signal to establish a fourth signal;

means for multiplying said fourth signal by a first gain term to establish a fifth signal;

means for multiplying said third signal by a second gain term to establish a sixth signal;

second lag means for lagging said sixth signal to thereby establish a seventh signal representative of a lagged said sixth signal;

means for adding a bias term to said seventh signal to establish an eighth signal; and means for summing said fifth signal and said eighth signal to establish the magnitude of said set point signal.

4. Apparatus in accordance with claim 3 wherein the time constant of said first lag means is about 30 seconds and the time constant of said first lag means is about 30 seconds and the time constant of said second lag means is about 1 minute.

5. Apparatus in accordance with claim 3 wherein said first gain term is equal to about 1.0, said second gain term is equal to about 1.2 and said bias term is equal to about 2.5.

6. Apparatus in accordance with claim 1 wherein the magnitude of said set point signal is changed periodically and wherein said means for establishing the magnitude of said set point signal comprises:

first lag means for lagging said first signal to thereby establish a third signal representative of a lagged said first signal;

means for subtracting said first signal from said third signal to establish a fourth signal;

means for multiplying said fourth signal by a first gain term to establish a fifth signal;

means for multiplying said third signal by a second gain term to establish a sixth signal;

second lag means for lagging said sixth signal to thereby establish a seventh signal representative of a lagged said sixth signal;

means for adding a bias term to said seventh signal to establish an eighth signal;

means for summing said fifth signal and said eighth signal to establish a ninth signal;

means for adding a constant to the value of said set point signal established one period earlier to establish a tenth signal;

a low select; and means for providing said ninth signal and said tenth signal to said low select, wherein the lower of said ninth and tenth signals is provided from said low select as said set point which establishes the magnitude of said set point signal.

7. Apparatus in accordance with claim 1 wherein a control valve is utilized to manipulate the flow of steam of said flare stack, wherein said second signal is scaled so as to be representative of the position of said control valve required to maintain a desired flow rate of steam to said flare stack, and wherein said means for manipulating the flow of steam to said flare stack comprises means for manipulating the position of said control valve in response to said second signal.

8. A method for controlling the flow rate of steam to a flare stack so as to reduce smoke emissions from said flare stack caused by the combustion of a combustible waste gas containing hydrocarbons in said flare stack, said method comprising the steps of:

establishing a first signal representative of the amount of infrared radiation from the flare stack flame at a time T;

establishing the magnitude of a set point signal in response to the magnitude of said first signal at said time T and generating said set point signal, wherein said set point signal has a magnitude which is not equal to the magnitude of said first signal if an increase in the flow rate of said steam is required to prevent the emission of smoke from said flare stack or if the flow rate of steam can be decreased without the emission of smoke from said flare stack occurring and wherein said set point signal has a magnitude substantially equal to the magnitude of said first signal if no change in the flow rate of said steam is desired;

comparing said first signal and said set point signal at said time T and establishing a second signal which is responsive to the difference between said first signal and said set point signal; and manipulating the flow rate of steam to said flare stack in response to said second signal.

9. A method in accordance with claim 8 wherein said step of establishing the magnitude of said set point signal comprises:

lagging said first signal to thereby establish a third signal representative of a lagged said first signal;

subtracting said first signal from said third signal to establish a fourth signal;

multiplying said fourth signal by a first gain term to establish a fifth signal;

multiplying said third signal by a second gain term to establish a sixth signal;

lagging said sixth signal to thereby establish a seventh signal representative of a lagged said sixth signal;

adding a bias term to said seventh signal to establish an eighth signal; and summing said fifth signal and said eighth signal to establish said set point signal.

10. A method in accordance with claim 8 wherein the magnitude of said set point signal is changed periodically and wherein said step of establishing the magnitude of said set point signal comprises:

lagging said first signal to thereby establish a third signal representative of a lagged said first signal;

subtracting said first signal from said third signal to establish a fourth signal;

multiplying said fourth signal by a first gain term to establish a fifth signal;

multiplying said third signal by a second gain term to establish a sixth signal;

lagging said sixth signal to thereby establish a seventh signal representative of a lagged said sixth signal;

adding a bias term to said seventh signal to establish an eighth signal;

summing said fifth signal and said eighth signal to establish a ninth signal;

adding a constant to the value of said set point signal established one period earlier to establish a tenth signal; and selecting the lower of said ninth and tenth signals to establish the magnitude of said set point signal.

11. A method in accordance with claim 8 wherein a control valve is utilized to control the flow of steam to said flare stack, wherein said second signal is scaled so as to be representative of the position of said control valve required to maintain a desired flow rate of steam to said flare stack, and wherein said step of manipulating the flow of steam to said flare stack comprises manipulating the position of said control valve in response to said second signal.

* * * * *